US011543078B2

(12) United States Patent
Marhem et al.

(10) Patent No.: US 11,543,078 B2
(45) Date of Patent: Jan. 3, 2023

(54) THERMALLY-INSULATING SEALED TANK

(71) Applicant: Gaztransport Et Technigaz, Saint Remy les Chevreuse (FR)

(72) Inventors: Mathieu Marhem, Saint Remy les Chevreuse (FR); Francois Durand, Saint Remy les Chevreuse (FR); Antoine Philippe, Saint Remy les Chevreuse (FR); Mickaël Herry, Saint Remy les Chevreuse (FR); Raphaël Prunier, Saint Remy les Chevreuse (FR); Sébastien Delanoe, Saint Remy les Chevreuse (FR); Bruno Deletre, Saint Remy les Chevreuse (FR); Mohamed Sassi, Saint Remy les Chevreuse (FR)

(73) Assignee: Gaztransport Et Technigaz, Saint Remy les Chevreuse (FR)

( * ) Notice: Subject to any disclaimer, the term of this patent is extended or adjusted under 35 U.S.C. 154(b) by 2 days.

(21) Appl. No.: 15/734,990

(22) PCT Filed: Jun. 6, 2019

(86) PCT No.: PCT/FR2019/051358
§ 371 (c)(1),
(2) Date: Dec. 3, 2020

(87) PCT Pub. No.: WO2019/234360
PCT Pub. Date: Dec. 12, 2019

(65) Prior Publication Data

US 2021/0231262 A1 Jul. 29, 2021

(30) Foreign Application Priority Data

Jun. 6, 2018 (FR) ..... 1854925
Nov. 9, 2018 (FR) ..... 1858144

(51) Int. Cl.
*F17C 3/02* (2006.01)
*F17C 13/00* (2006.01)

(52) U.S. Cl.
CPC ..... *F17C 3/027* (2013.01); *F17C 13/001* (2013.01); *F17C 2203/0358* (2013.01); *F17C 2221/033* (2013.01); *F17C 2270/0107* (2013.01)

(58) Field of Classification Search
CPC . B63B 25/00; B63B 25/16; F17C 3/00; F17C 3/02; F17C 3/027; F17C 13/00;
(Continued)

(56) References Cited

U.S. PATENT DOCUMENTS 9,677,711 B2 6/2017 Boyeau et al.
2015/0354756 A1 12/2015 Philippe et al.
(Continued)

FOREIGN PATENT DOCUMENTS

EP 0064886 11/1982
EP 0064886 B1 7/1985
(Continued)

OTHER PUBLICATIONS

Written Opinion and Search Report from Singapore Patent Application No. 112020121155 dated Jun. 7, 2022.
(Continued)

*Primary Examiner* — Lars A Olson
(74) *Attorney, Agent, or Firm* — Blank Rome LLP

(57) ABSTRACT

The invention relates to a tank wall (1) fixed onto a supporting wall (3) wherein the secondary insulating barrier comprises a plurality of secondary rows (A, B, C) parallel to a first direction and juxtaposed in a second direction at right angles to the first direction according to a repeated pattern. The secondary sealed membrane comprises a plurality of strakes (21) parallel to the first direction, the size of the repeated pattern of the secondary rows (A, B, C) being an
(Continued)

integer multiple of the size of a strake (21) in the second direction. The primary insulating barrier (5) comprises a plurality of primary rows parallel to the first direction, and the primary sealed membrane has first corrugations (56) parallel to the first direction and spaced apart by a first regular spacing (58), wherein the size of the repeated pattern of the primary rows is an integer multiple of said first regular spacing (58).

30 Claims, 8 Drawing Sheets

(58) Field of Classification Search
CPC ..... F17C 13/001; F17C 2203/0358; F17C 2270/0107
USPC ..... 114/74 A
See application file for complete search history.

(56) References Cited

U.S. PATENT DOCUMENTS

| | | | |
|---|---|---|---|
| 2016/0252211 | A1 | 9/2016 | Boyeau et al. |
| 2017/0276295 | A1 | 9/2017 | Herry et al. |
| 2017/0320549 | A1 | 11/2017 | Park et al. |
| 2018/0073678 | A1 | 3/2018 | Givoloup et al. |

FOREIGN PATENT DOCUMENTS

| | | |
|---|---|---|
| FR | A-2887010 | 12/2006 |
| FR | A-3001945 | 8/2014 |
| JP | 2016-515978 A | 6/2016 |
| KR | 20140044133 | 4/2014 |
| WO | WO-A-89/09909 | 10/1989 |
| WO | WO-2008007837 | 1/2008 |
| WO | WO-2008147003 | 12/2008 |
| WO | WO2012-127141 | 9/2012 |
| WO | WO-A-201 3093262 | 6/2013 |
| WO | WO-201 7034117 | 3/2017 |

OTHER PUBLICATIONS

Office Action dated Sep. 13, 2022 from corresponding JP Patent Application No. 2020-567483.

THERMALLY-INSULATING SEALED TANK

RELATED APPLICATIONS

The present application is a national stage of International Application No. PCT/FR2019/051358, filed Jun. 6, 2019, which claims priority to French Patent Application No. 1854925, filed Jun. 6, 2018, and French Patent Application No. 1858144, filed Sep. 11, 2018, all of which are incorporated herein by reference.

TECHNICAL FIELD

The invention relates to the field of tanks, thermally insulating sealed tanks, with membranes, for storing and/or transporting fluid, such as a liquefied gas.

Thermally insulating sealed tanks with membranes are notably employed for storage of liquefied natural gas (LNG), which is stored, at atmospheric pressure, at approximately −163° C. These tanks can be installed onshore or on a floating structure. In the case of a floating structure, the tank can be intended to transport liquefied natural gas or to receive liquefied natural gas used as fuel to propel the floating structure.

TECHNOLOGICAL BACKGROUND

The document WO-A-89/09909 discloses a thermally insulating sealed tank for storing liquefied natural gas arranged in a supporting structure and whose walls have a multilayer structure, namely, from the outside to the inside of the tank, a secondary thermally insulating barrier anchored against the supporting structure, a secondary sealed membrane which is supported by the secondary thermally insulating barrier, a primary thermally insulating barrier which is supported by the secondary sealed membrane and a primary sealed membrane which is supported by the primary thermally insulating barrier and which is intended to be in contact with the liquefied natural gas stored in the tank. The primary insulating barrier comprises a set of rigid plates which are secured by means of welding supports of the secondary sealed membrane.

In one embodiment, the primary sealed membrane is formed by an assembly of rectangular metal sheets comprising corrugations in two right-angled directions, said metal sheets being welded together with overlap and being welded by their edges to metal strips fixed in rabbets along edges of the plates of the primary insulating barrier.

SUMMARY

One idea on which the invention is based consists in providing a tank wall that aggregates the advantages of a secondary membrane formed by parallel strakes, the robustness of which has been proven through experience, and a corrugated primary membrane, which can exhibit a good resistance to accidental indentations and other stresses, resulting for example from thermal contraction, movements of the cargo and/or the distortion of the ship beam at sea.

Another idea on which the invention is based consists in providing a tank wall which is relatively easy to manufacture and which allow use of different types of corrugated sealed membranes as primary membrane.

According to one embodiment, the invention proposes a thermally insulating sealed tank incorporated in a supporting structure, the tank comprising a tank wall fixed onto a supporting wall of the supporting structure, the tank wall comprising a primary sealed membrane intended to be in contact with a product contained in the tank, a secondary sealed membrane arranged between the primary sealed membrane and the supporting wall, a primary insulating barrier arranged between the primary sealed membrane and the secondary sealed membrane and a secondary insulating barrier arranged between the secondary sealed membrane and the supporting wall, wherein the secondary insulating barrier comprises a plurality of secondary rows parallel to a first direction, a secondary row comprising a plurality of juxtaposed parallelepipedal secondary insulating panels, the secondary rows being juxtaposed in a second direction at right angles to the first direction according to a repeated pattern, wherein the secondary sealed membrane comprises a plurality of strakes parallel to the first direction, made of an alloy with low expansion coefficient, the expansion coefficient of which is for example less than or equal to $7.10^{-6}\ K^{-1}$, a strake comprising a flat central portion resting on a top surface of the secondary insulating panels and two raised edges protruding toward the interior of the tank with respect to the central portion, the strakes being juxtaposed in the second direction according to a repeated pattern and welded together tightly at the raised edges, anchoring wings anchored to the secondary insulating panels and parallel to the first direction being arranged between the juxtaposed strakes, to hold the secondary sealed membrane on the secondary insulating barrier, wherein the size of the repeated pattern of the secondary rows is an integer multiple of the size of a strake in the second direction, wherein the supporting wall supports secondary retaining members disposed at the interfaces between the secondary rows and cooperating with the secondary insulating panels to hold the secondary insulating panels on the supporting wall, and wherein the primary insulating barrier comprises a plurality of primary rows parallel to the first direction, one or each primary row comprising a plurality of juxtaposed parallelepipedal primary insulating panels and being, for example, superposed on a secondary row or straddling at least two secondary rows, the primary rows being juxtaposed in the second direction according to a repeated pattern, the size of the repeated pattern of the primary rows being equal to the size of the repeated pattern of the secondary rows in the second direction.

According to one embodiment, primary retaining members, for example supported by the secondary retaining members or by the secondary insulating panels, are disposed at the interfaces between the primary rows and cooperate with the primary insulating panels to hold the primary insulating panels on the secondary sealed membrane.

According to one embodiment, the primary rows are offset in the second direction by a fraction, for example half, of the size of the repeated pattern of the secondary rows with respect to the secondary rows. By virtue of such an offset, it is possible to limit or eliminate the vertical alignments between primary retaining members and secondary retaining members, which limits the occurrences of thermal bridges brought about by such alignments.

Another advantage from the offsetting of the primary rows in the first direction and/or the second direction is to obtain a more uniform distribution of the loads passing through the membranes and the primary insulation and being reflected on the secondary insulating panels and the supporting wall. Indeed, in this case, a pressure load exerted on a primary insulating panel is distributed over several, for example two or four, underlying secondary insulating panels.

According to one embodiment, the interfaces between the primary insulating panels within a primary row are offset in the first direction with respect to the interfaces between the secondary insulating panels within the two secondary rows on which the primary row is superposed.

Preferably in this case, the primary retaining members are supported by the secondary insulating panels at a distance from the edges of the secondary insulating panels, for example at the centers of the secondary insulating panels.

Such primary retaining members can be provided on all the secondary retaining members or on all the secondary insulating panels, for example if the primary insulating panel has the same dimensions as the secondary insulating panel, or on some of the secondary retaining members or some of the secondary insulating panels, for example if the primary insulating panel is longer than the secondary insulating panel or if the primary insulating panel is offset only in the first direction.

According to one embodiment, a primary retaining member comprises a plate fixed to a cover plate of the secondary insulating panel under the secondary sealed membrane and a rod attached to said plate, fixedly or with a horizontal play, and passing tightly through the secondary sealed membrane toward the primary insulating barrier.

According to one embodiment, the primary sealed membrane has first corrugations parallel to the first direction and disposed according to a repeated pattern in the second direction and flat portions situated between the first corrugations and resting on a top surface of the primary insulating panels, and the size of the repeated pattern of the primary rows is an integer multiple of the size of the repeated pattern of the first corrugations, the primary sealed membrane comprising a plurality of rows of metal sheets parallel to the first direction, a row of metal sheets comprising a plurality of rectangular metal sheets welded together tightly by edge zones, with or without mutual overlap, the rows of metal sheets being juxtaposed in the second direction and welded together tightly, the size of a row of metal sheets in the second direction being equal to an integer multiple of the size of the repeated pattern of the primary rows.

The repeated pattern of the first corrugations can be a repeated pattern comprising one corrugation or several corrugations. A repeated pattern comprising a single corrugation means that the first corrugations are spaced apart by a first regular spacing in the second direction and the size of the repeated pattern is equal to this first regular spacing. In this case, the size of the repeated pattern of the primary rows is an integer multiple of said first regular spacing. A repeated pattern comprising several corrugations means that the spacing of the corrugations is not necessarily regular, but that all the spacings are repeated at a regular interval, called size of the repeated pattern of the corrugations.

According to one embodiment, the rows of metal sheets are offset in the second direction with respect to the primary rows so that the welded joins between the rows of metal sheets are situated at a distance from the interfaces between the primary rows, that is to say notably at a distance from the retaining members.

By virtue of these features, the welded joins between the rows of metal sheets of the primary sealed membrane can be essentially produced at a distance from the edges of the primary insulating panels parallel to the first direction, therefore on a surface having a high level of flatness. The result thereof is a lesser risk of local variation of the welds and a higher membrane quality level obtained.

According to other advantageous embodiments, such a tank can have one or more of the following features.

According to one embodiment, a primary row comprises a plurality of parallelepipedal primary insulating panels juxtaposed according to a repeated pattern and a row of metal sheets of the primary sealed membrane comprises a plurality of rectangular metal sheets juxtaposed according to a repeated pattern, the size of the repeated pattern of the rectangular metal sheets being equal to an integer multiple of the size of the repeated pattern of the primary insulating panels in the first direction.

According to one embodiment, the edges of the rectangular metal sheets are offset in the first direction with respect to the edges of the primary insulating panels parallel to the second direction, such that the welded joins between the rectangular metal sheets are situated at a distance from the edges of the primary insulating panels parallel to the second direction.

According to one embodiment, the primary insulating panels and/or the secondary insulating panels have a square form.

The repeated pattern of the primary rows and/or the repeated pattern of the secondary rows may or may not have a gap in the second direction. If there is a gap between two rows, the size of the repeated pattern is equal to the sum of the size of the primary or secondary insulating panel and the size of the gap.

Likewise, the repeated pattern of the primary or secondary insulating panels within a primary or secondary row may or may not have a gap in the first direction. If there is a gap between two primary or secondary insulating panels, the size of the repeated pattern is equal to the sum of the size of the primary or secondary insulating panel and the size of the gap.

According to one embodiment, the size of a strake in the second direction is an integer multiple of said first regular spacing. These features facilitate the option to choose the orientation of the strakes according to the local demands of the target application.

According to one embodiment, the primary sealed membrane also has second corrugations parallel to the second direction and disposed according to a repeated pattern in the first direction, the flat portions being situated between the first corrugations and the between the second corrugations.

The repeated pattern of the second corrugations can be a repeated pattern comprising one corrugation or several corrugations. A repeated pattern comprising a single corrugation means that the second corrugations are spaced apart by a second regular spacing in the first direction. In this case, the second regular spacing can be equal to or different from the first regular spacing. A repeated pattern comprising several corrugations means that the spacing of the corrugations is not necessarily regular, but that all the spacings are repeated at a regular interval, called size of the repeated pattern of the corrugations.

According to embodiments, the first and second corrugations can be continuous or discontinuous at the intersections between first and second corrugations. With continuous corrugations, it is possible to produce continuous channels, for example for the circulation of a neutral gas, between the primary sealed membrane and the primary insulating barrier. With discontinuous corrugations, it is easier to form the metal sheet by chasing.

According to one embodiment, the size of the repeated pattern of the primary insulating panels is an integer multiple of the size of the repeated pattern of the second corrugations, for example an integer multiple of said second regular spacing.

According to one embodiment, a rectangular metal sheet of the primary sealed membrane has a size in the first direction substantially equal to an integer multiple of the size of the repeated pattern of the second corrugations or an integer multiple of the second regular spacing. A slight difference can exist between these two quantities, less than the size of the overlap between two adjacent metal sheets.

The primary sealed membrane is held on the primary insulating barrier by anchoring means which can be produced in different ways.

According to one embodiment, the anchoring means comprise metal anchoring strips fixed onto the primary insulating panels at locations corresponding to outlines of the rectangular metal sheets and to which edge zones of the rectangular metal sheets can be welded. A primary insulating panel can notably comprise an anchoring strip for fixing a straight edge of one or more rectangular metal sheets or two secant anchoring strips for fixing a corner zone of one or more rectangular metal sheets.

According to one embodiment, the anchoring means comprise metal inserts, for example in the form of disks, fixed onto the primary insulating panels at locations corresponding to edge zones of the primary insulating panels at a distance from the outlines of the rectangular metal sheets and to which central zones of the rectangular metal sheets can be welded.

According to one embodiment, a primary insulating panel comprises relaxation slits hollowed out in a thicknesswise direction of the primary insulating panel and emerging on a cover plate of the primary insulating panel. According to embodiments, one or each metal anchoring strip can comprise several aligned segments, fixed onto the cover plate and separated by relaxation slits and/or the metal inserts can be fixed to the cover plate between the relaxation slits.

According to one embodiment, at least one of the insulating panels comprises a bottom plate resting against the supporting structure or the secondary sealed membrane, an intermediate plate disposed between the bottom plate and the cover plate, a first layer of insulating polymer foam sandwiched between the bottom plate and the intermediate plate and a second layer of insulating polymer foam sandwiched between the intermediate plate and the cover plate. Such a structure is advantageous in that it allows the flexing loads generated by the differential contraction of the materials of the insulating panel to be limited.

According to one embodiment, voids are formed in the second layer of insulating polymer foam so that the intermediate plate overlaps with respect to the second layer of insulating polymer foam and thus forms one of the bearing zones for the secondary retaining members.

According to one embodiment, the first layer of insulating polymer foam has, in each of the corner zones of the insulating panel, a cutout housing a pillar which extends between the bottom plate and the intermediate plate. This makes it possible to limit the crushing and the creep of the foam.

According to another embodiment, at least one of the insulating panels comprises a bottom plate, a cover plate and supporting webs extending, in the thicknesswise direction of the tank wall, between the bottom plate and the cover plate and delimiting a plurality of compartments filled with an insulating lining, such as perlite.

According to one embodiment, a bridging element can be fixed to the top surfaces of several adjacent primary insulating panels, for example of two or four adjacent primary insulating panels, for example to the cover plates of the adjacent primary insulating panels, to avoid a separation of the adjacent primary insulating panels, in other words to avoid the creation of a gap between the adjacent primary insulating panels or at least the widening thereof. According to one embodiment, the primary insulating panels have facings on edges of the top surface to receive the bridging element or elements, for example bridging plates made of plywood.

According to one embodiment, the fluid is a liquefied gas, such as liquefied natural gas.

Such a tank can form part of an onshore storage installation, for example for storing LNG or be installed in a floating, coastal or deep water structure, notably a methane tanker, a floating storage and regasification unit (FSRU), a floating production and storage offshore unit (FPSO) and the like.

According to one embodiment, a ship for transporting a cryogenic fluid comprises a double hull and an abovementioned tank disposed in the double hull.

According to one embodiment, the double hull comprises an internal hull forming the supporting structure of the tank.

According to one embodiment, the invention also provides a method for loading or offloading such a ship, in which a fluid is conveyed through insulated pipelines from or to a floating or onshore storage installation to or from the tank of the ship.

According to one embodiment, the invention also provides a transfer system for a fluid, the system comprising the abovementioned ship, insulated pipelines arranged so as to link the tank installed in the hull of the ship to a floating or onshore storage installation and a pump for driving a fluid through the insulated pipelines from or to the floating or onshore storage installation to or from the tank of the ship.

BRIEF DESCRIPTION OF THE FIGURES

The invention will be better understood, and other aims, details, features and advantages thereof will become more clearly apparent from the following description of several particular embodiments of the invention, given in a purely illustrative and nonlimiting manner, with reference to the attached drawings.

DETAILED DESCRIPTION OF EMBODIMENTS

Figure 1:
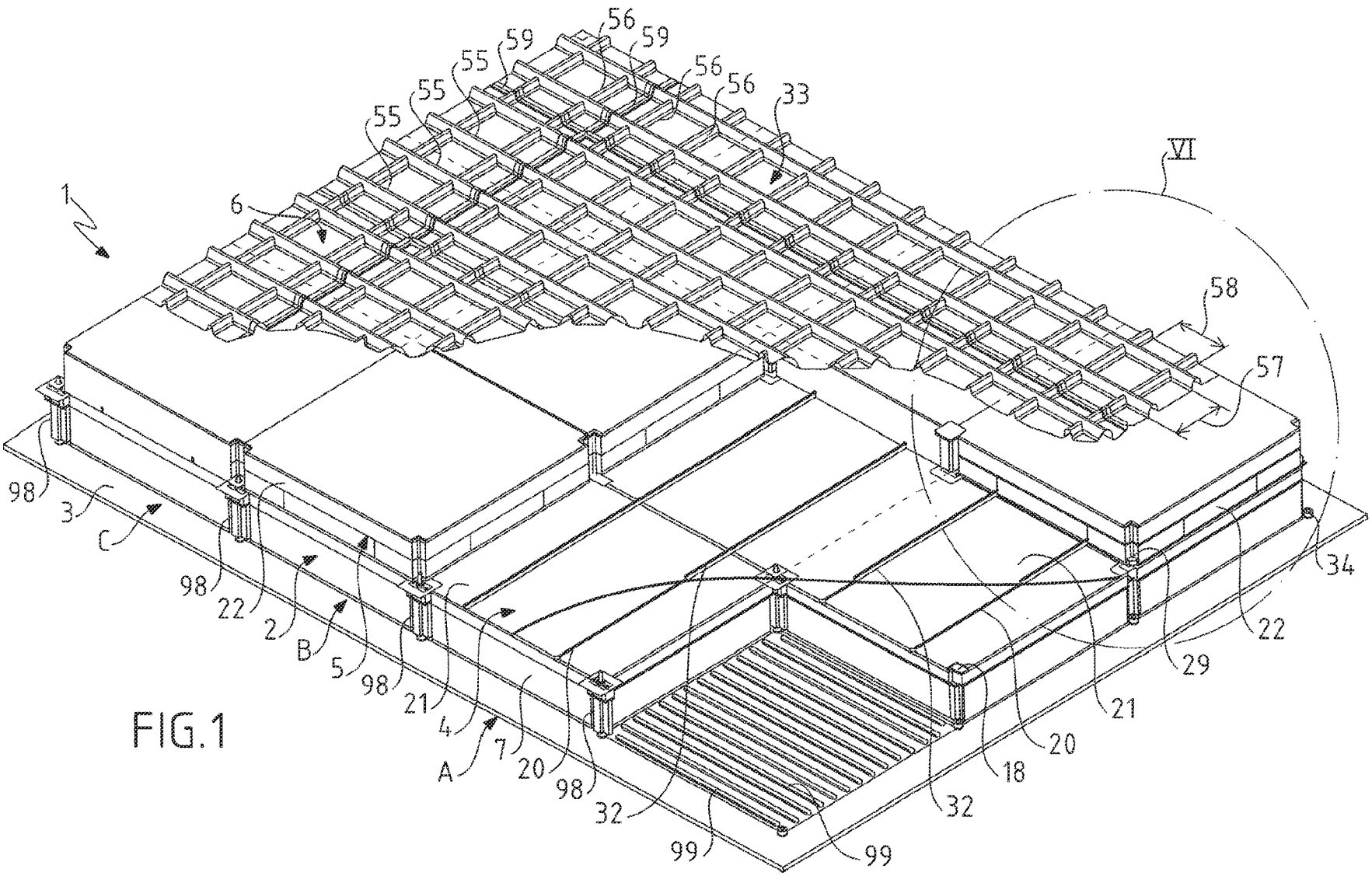
FIG. 1 is a cutaway perspective view of a tank wall.

FIG. 1 shows the multilayer structure of a wall 1 of a thermally insulating sealed tank for storing a liquefied fluid, such as liquefied natural gas (LNG). Each wall 1 of the tank comprises, in succession, in the thicknesswise direction, from the outside to the inside of the tank, a secondary thermally insulating barrier 2 held on a supporting wall 3, a secondary sealed membrane 4 resting against the secondary thermally insulating barrier 2, a primary thermally insulating barrier 5 resting against the secondary sealed membrane 4 and a primary sealed membrane 6 intended to be in contact with the liquefied natural gas contained in the tank.

The supporting structure can notably be formed by the hull or the double hull of a ship. The supporting structure comprises a plurality of supporting walls 3 defining the general form of the tank, usually a polyhedral form.

The secondary thermally insulating barrier 2 comprises a plurality of secondary insulating panels 7 which are anchored to the supporting wall 3 by means of retaining devices 98 which are described in detail hereinbelow. The secondary insulating panels 7 have a generally parallelepipedal form and are disposed in parallel rows. Three rows are indicated by the letters A, B and C. Rolls of mastic 99 are interposed between the secondary insulating panels 7 and the supporting wall 3 to make up the differences between the supporting wall 3 and a flat reference surface. A kraft paper is inserted between the rolls of mastic 99 and the supporting wall 3 to prevent the rolls of mastic 99 from adhering to the supporting wall 3.

Figure 2:
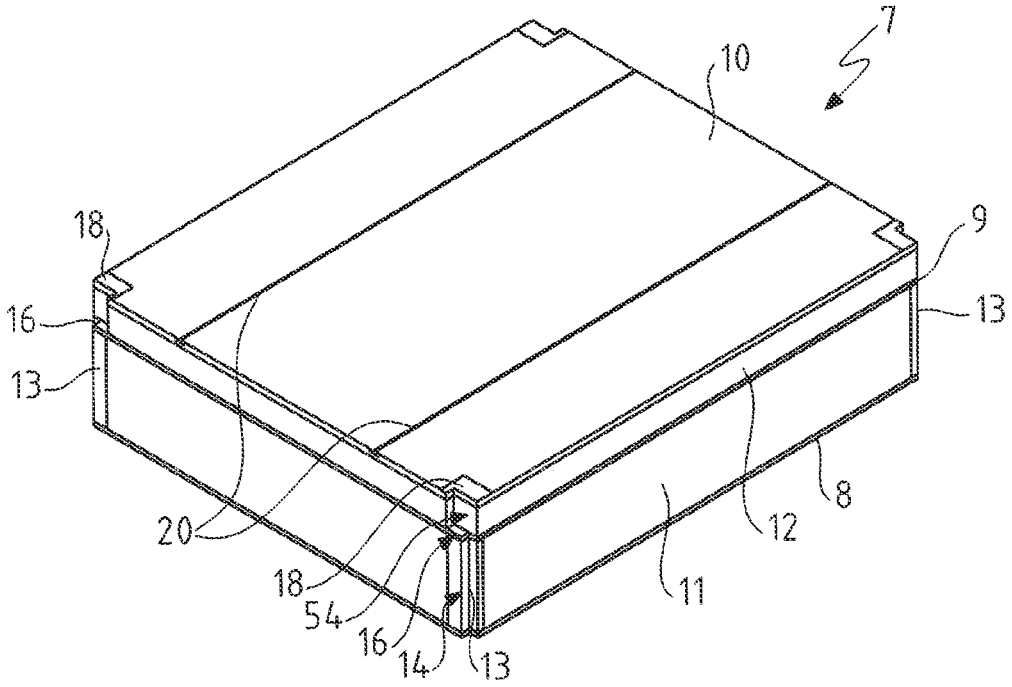
FIG. 2 is a perspective view of a secondary insulating panel that can be used in the tank wall.

FIG. 2 represents the structure of a secondary insulating panel 7 according to one embodiment. The secondary insulating panel 7 here comprises three plates, namely a bottom plate 8, an intermediate plate 9 and a cover plate 10. The bottom 8, intermediate 9 and cover 10 plates are, for example, made of plywood. The secondary insulating panel 7 also comprises a first layer of insulating polymer foam 11 sandwiched between the bottom plate 8 and the intermediate plate 9 and a second layer of insulating polymer foam 12 sandwiched between the intermediate plate 9 and the cover plate 10. The first and second layers of insulating polymer foam 11, 12 are respectively glued to the bottom plate 8 and the intermediate plate 9 and to the intermediate plate 9 and the cover plate 10. The insulating polymer foam can notably be a foam based on polyurethane, optionally reinforced with fibers.

The first layer of insulating polymer foam 11 has, in the corner zones, cutouts to allow the passage of corner pillars 13. The corner pillars 13 extend, in the four corner zones of the secondary insulating panel 7, between the bottom plate 8 and the intermediate plate 9. The corner pillars 13 are fixed, for example by means of staples or screws or glue, to the bottom plate 8 and the intermediate plate 9. The corner pillars 13 are, for example, made of plywood or of plastic. The corner pillars 13 are used to take up a part of the compression load in service and to limit the crushing and the creep of the foam. Such corner pillars 13 have a thermal contraction coefficient different from that of the first layer of insulating polymer foam 11. Also, when the tank is cooled down, the deflection of the secondary insulating panel 7 can be weaker at the corner pillars 13 than in the other zones.

Moreover, the secondary insulating panel 7 comprises voids 14, 54 in its corner zones to receive retaining devices 98 which will be detailed hereinbelow. The secondary insulating panel 7 comprises, from the bottom plate 8 to the intermediate plate 9, a first void 14 intended to allow the passage of a rod 15 of the retaining device 98. Above the intermediate plate 9, the secondary insulating panel 7 comprises a second void 54. The second void 54 has dimensions greater than those of the first void 14 so that the intermediate plate 9 overlaps with respect to the second layer of insulating polymer foam 12 and the cover plate 10. Thus, the intermediate plate 9 forms, in the corner zones of the secondary insulating panel 7, a bearing zone 16 intended to cooperate with a secondary bearing plate 17 of the retaining device 98.

Moreover, the cover plate 10 has a facing 18 in these four corner zones. Each facing 18 is intended to receive a load distribution plate 19 of the retaining device 98. The facings 18 have a thickness substantially similar to that of the load distribution plate 19 such that the load distribution plate 19 is flush with the top surface of the cover plate 10. The cover plate 10 also comprises grooves 20 for receiving welding supports.

The structure of the secondary insulating panel 7 is described above by way of example. So, in another embodiment, the secondary insulating panels 7 can have another general structure, for example that described in the document WO2012/127141. The secondary insulating panels 7 are then produced in caisson form comprising a bottom plate, a cover plate and supporting webs extending, in the thicknesswise direction of the tank wall 1, between the bottom plate and the cover plate and delimiting a plurality of compartments filled with an insulating lining, such as perlite, glass wool or rock wool.

To return to FIG. 1, it can be seen that the secondary sealed membrane 4 comprises a continuous sheet of metal strakes 21, with raised edges. The strakes 21 are welded by their raised edges 32 onto parallel welding supports which are fixed in the grooves 20 formed on the cover plates 10 of the secondary insulating panels 7. The strakes 21 are, for example, made of Invar®; that is to say an alloy of iron and nickel whose expansion coefficient is typically between $1.2.10^{-6}$ and $2.10^{-6}$ $K^{-1}$. It is also possible to use alloys of iron and manganese whose expansion coefficient is typically of the order of $7.10^{-6}$ $K^{-1}$.

The primary thermally insulating barrier 5 comprises a plurality of primary insulating panels 22 which are anchored to the supporting wall 3 by means of the abovementioned retaining devices 98. The primary insulating panels 22 have a generally parallelepipedal form. Furthermore, they have dimensions identical to those of the primary insulating panels 22, except for their thickness in the thicknesswise direction of the tank wall 1 which can be different, and notably smaller. Each of the primary insulating panels 22 is positioned in line with one of the secondary insulating panels 7, in the alignment thereof in the thicknesswise direction of the tank wall 1.

Figure 3:
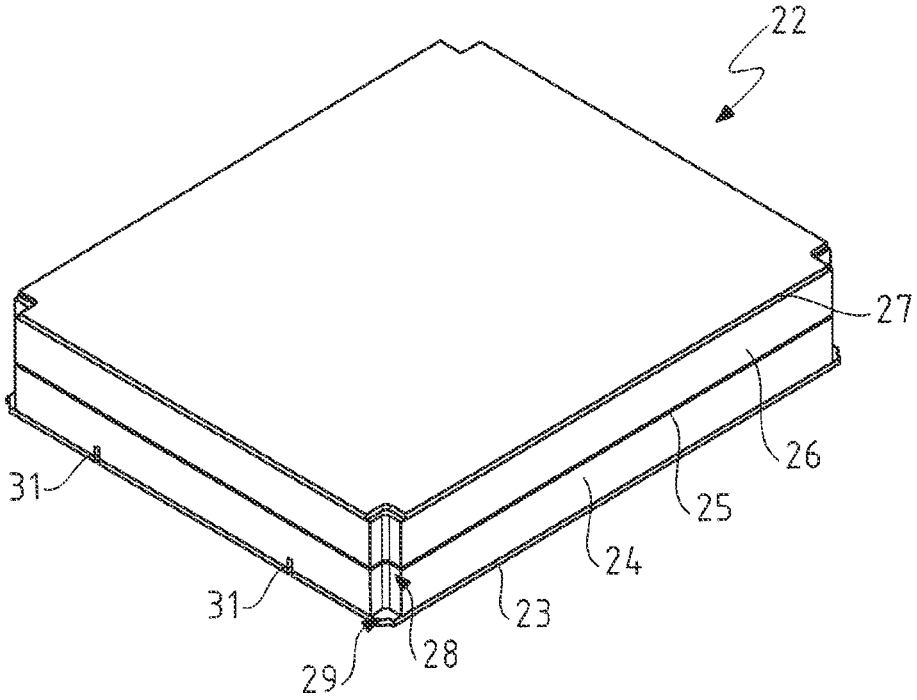
FIG. 3 is a perspective view of a primary insulating panel that can be used in the tank wall.

FIG. 3 represents the structure of a primary insulating panel 22 according to one embodiment. The primary insulating panel 22 has a multilayer structure similar to that of the secondary insulating panel 7 of FIG. 2. So, the primary insulating panel 22 comprises, in succession, a bottom plate 23, a first layer of insulating polymer foam 24, an intermediate plate 25, a second layer of insulating polymer foam 26 and a cover plate 27. The insulating polymer foam can notably be a foam based on polyurethane, optionally reinforced with fibers.

The primary insulating panel 22 comprises voids 28 in its corner zones so that the bottom plate 23 overlaps with respect to the first layer of insulating polymer foam 24, the intermediate plate 25, the second layer of insulating polymer foam 26 and the cover plate 27. Thus, the bottom plate 23 forms, in the corner zones of the primary insulating panel 22, a bearing zone 29 intended to cooperate with a primary bearing plate 30 of the retaining device 98. In a manner that is not represented, a shim can be added to the bottom plate 23, said shim having a form similar to that of the bearing zone 29 and being intended to cooperate with the primary bearing plate 30 of the retaining device 98.

The bottom plate 23 comprises grooves 31 intended to receive the raised edges 32 of the strakes 21 of the secondary sealed membrane 4. The cover plate 27 can also comprise anchoring means, not represented in FIGS. 1 and 3, for anchoring the primary sealed membrane 6.

The structure of the primary insulating panel 22 is described above by way of example. So, in another embodiment, the primary insulating panels 22 can have another general structure, for example that described in the document WO2012/127141.

In another embodiment, the primary thermally insulating barrier 5 comprises primary insulating panels 22 that have at least two different types of structure, for example the above-mentioned two structures, depending on where they are located in the tank.

FIG. 1 also shows that the primary sealed membrane 6 comprises a continuous sheet of rectangular metal sheets 33 which have two series of mutually right-angled corrugations. The first series of corrugations 55 extends at right angles to the rows of insulating panels A, B, C and therefore at right angles to the raised edges 32 of the strakes 21 and has a regular spacing 57. The second series of corrugations 56 extends parallel to the rows of insulating panels A, B, C and therefore parallel to the raised edges 32 of the strakes 21 and has a regular spacing 58. Preferably, the first series of corrugations 55 is higher than the second series of corrugations 56.

The rectangular metal sheets 33 are welded together forming small zones of overlap 59 along their edges, according to the known technique.

A rectangular metal sheet 33 preferably has width and length dimensions which are integer multiples of the spacing of the corresponding corrugations and also integer multiples of the dimensions of the primary insulating panels 22. FIG. 1 shows a rectangular metal sheet 33 which measures 4 times the spacing 57 by 12 times the spacing 58. Preferably, the spacings 57 and 58 are equal. Thus, the orientation of the corrugations 55 and 56 in the tank can easily be adapted to the requirements of the application without resulting in significant modifications with respect to the production of the insulation barriers.

For example, in a variant embodiment, the primary sealed membrane 6 is turned by 90° so that the first series of corrugations 55 extends parallel to the rows of insulating panels A, B, C and therefore parallel to the raised edges 32 of the strakes 21.

The primary insulating panels 22 and the secondary insulating panels 7 have the same dimension in the widthwise direction of the rows A, B, C. This dimension will be called length of the insulating panels by convention. This row width is an integer multiple of the spacing of the corrugations in the same direction, here the spacing 58, and an integer multiple of the width of the strakes 21, to facilitate the production of the tank wall in a modular fashion forming repeated patterns a large number of times over substantially all the supporting wall 3.

Preferably, the width of a strake 21 is an integer multiple of the spacing of the corrugations in the same direction, for example double.

In the lengthwise direction of the rows A, B, C, a primary insulating panel 22 can have the same dimension as a secondary insulating panel 7 or an integer multiple of this dimension. This dimension is an integer multiple of the spacing of the corrugations in the same direction, here the spacing 57, to facilitate the production of the tank wall in a modular fashion forming repeated patterns a large number of times over all the supporting wall 3.

Preferably, the primary insulating panels 22 and the secondary insulating panels 7 are of square form. Thus, it is easier to adapt the relative orientation of the strakes and of the corrugations in the tank without requiring significant modifications in the design of the insulating panels.

Preferred Dimensional Example

Spacing of the corrugations 57, 58: PO

Width of the primary insulating panel 22 and of the secondary insulating panel 7: 4PO Length of the primary insulating panel 22 and of the secondary insulating panel 7: 4PO (square form)

Width of a strake 21: 2PO

Length of a metal sheet 33: 12PO (FIG. 1) or 8PO (not represented)

Width of a metal sheet 33: 4PO

PO=300 mm.

With these dimensions, a good trade-off is obtained between ease of handling of the constituent parts of the tank wall and the number of parts that have to be assembled. This arrangement also simplifies the connection of the corrugations between two walls of a tank.

Dimensional Example 2

Spacing of the corrugations 58: PO

Spacing of the corrugations 57: GO

Width of the primary insulating panel 22 and of the secondary insulating panel 7: 3GO Length of the primary insulating panel 22 and of the secondary insulating panel 7: 4PO (rectangular form)

Width of a strake 21: 2PO

Length of a metal sheet 33: 12PO

Width of a metal sheet 33: 3GO

PO=300 mm

GO=340 mm

Example 3

The corrugations 55 are not equidistant, but disposed according to a repeated pattern of four corrugations 55, whose successive spacings are:

340; 340; 340; 180 mm

Preferably, the interval of 180 mm is divided into two portions of 90 mm situated on two opposite edges of the rectangular metal sheet 33.

The dimension of the repeated pattern is therefore 1200 mm. For the remainder, the dimensions of the first example are retained.

Example 4

The corrugations 55 are not equidistant, but disposed according to a repeated pattern of four corrugations 55, whose successive spacings are:

300; 400; 300; 200 mm

Preferably, the interval of 200 mm is divided into two portions of 100 mm situated on two opposite edges of the rectangular metal sheet 33.

The dimension of the repeated pattern is therefore 1200 mm. For the remainder, the dimensions of the first example are retained.

As represented in FIG. 1, the retaining devices 98 are positioned in the four corners of the primary 22 and secondary 7 insulating panels. Thus, each stack of a secondary insulating panel 7 and a primary insulating panel 22 is anchored to the supporting wall 3 by means of four retaining devices 98. Thus, the retaining device 98 here comprises a primary retaining member superposed on a secondary retaining member. Furthermore, each retaining device 98 cooperates with the corners of four adjacent secondary insulating panels 7 and with the corners of four adjacent primary insulating panels 22.

Figure 4:
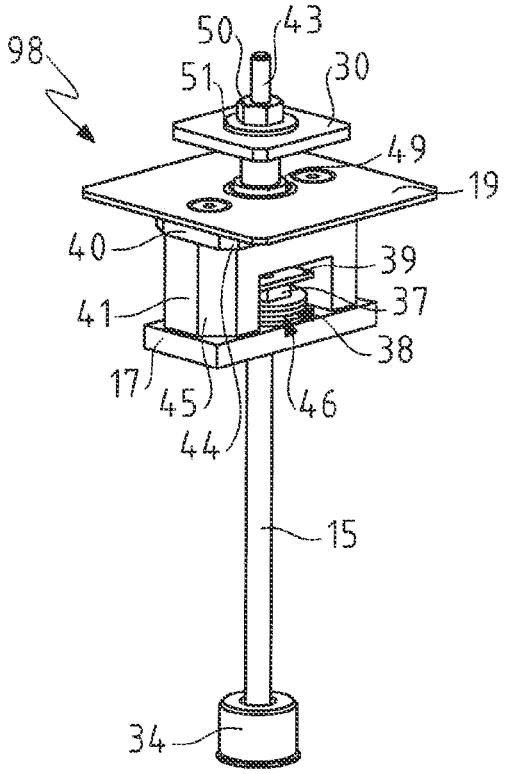
FIG. 4 is a perspective view of a retaining device that can cooperate with primary insulating panels and secondary insulating panels in order to hold them against the supporting structure.
Figure 5:
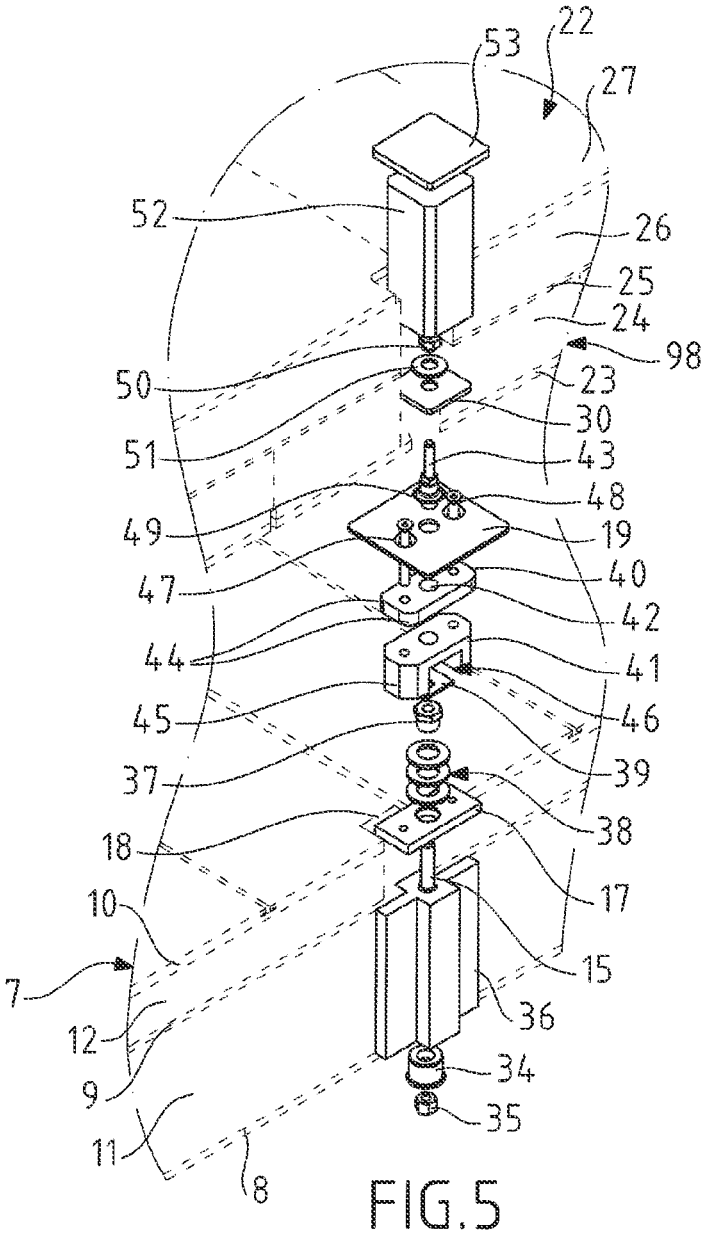
FIG. 5 is an exploded view of the retaining device of FIG. 4.

FIGS. 3 and 4 illustrate more specifically the structure of a retaining device 98 according to one embodiment.

The retaining device 98 comprises a bush 34 whose base is welded to the supporting wall 3 in a position which corresponds to a clearance in the corner zones of four adjacent secondary insulating panels 7. The bush 34 houses a nut 35, represented in FIG. 4, in which the bottom end of a rod 15 is screwed. The rod 15 runs between the adjacent secondary insulating panels 7.

The rod 15 passes through a bore formed in an insulating plug 36 intended to ensure a continuity of the secondary thermal insulation at the retaining device 98. The insulating plug 36 has, in a plane orthogonal to the thicknesswise direction of the tank wall 1, a cross-form section which is defined by four branches. Each of the four branches is inserted into a gap formed between two of the four adjacent secondary insulating panels 7.

The retaining device 98 also comprises a secondary bearing plate 17 which bears toward the supporting wall 3 against the bearing zone 16 formed in each of the four adjacent secondary insulating panels 7 in order to hold them against the supporting wall 3. In the embodiment represented, the secondary bearing plate 17 is housed in the second void 54 formed in the second layer of insulating polymer foam 12 of each of the secondary insulating panels 7 and bears against a zone of the intermediate plate 9 which forms the bearing zone 16.

A nut 37 cooperates with a threading formed at the top end of the rod 15 so as to ensure that the secondary bearing plate 17 is retained on the rod 15.

In the embodiment represented, the retaining device 98 also comprises one or more elastic washers 38, of Belleville type. The elastic washers 38 are threaded onto the rod 15 between the nut 37 and the secondary bearing plate 17, which makes it possible to ensure an elastic anchoring of the secondary insulating panels 7 on the supporting wall 3. Furthermore, advantageously, a locking member 39 is welded locally onto the top end of the rod 15, so as to fix the nut 37 in position on the rod 15.

The retaining device 98 also comprises a load distribution plate 19, a top plate 40 and a spacer 41 which are fixed to the secondary bearing plate 17.

The load distribution plate 19 is housed in each of the facings 18 formed in the cover plates 10 of the four adjacent secondary insulating panels 7. The load distribution plate 19 is therefore positioned between the cover plates 10 of each of the four secondary insulating panels and the secondary sealed membrane 4. The purpose of the load distribution plate 19 is to attenuate the level difference phenomena between the corners of the adjacent secondary insulating panels 7. Also, the load distribution plate 19 makes it possible distribute the strains likely to be exerted on the secondary sealed membrane 4 and the primary insulating panels 22 in line with the corner zones of the secondary insulating panels 7. Consequently, the load distribution plate 19 makes it possible to limit the phenomena of punching of the bottom plates 23 of the primary insulating panels 22 and of punching and of packing of the layers of insulating polymer foam 24, 26 of the primary insulating panels 22 in line with the corner zones of the secondary insulating panels 7.

The load distribution plate 19 is advantageously produced in a metal chosen from among stainless steel, the alloys of iron and nickel, such as invar, whose expansion coefficient is typically between $1.2.10^{-6}$ and $2.10^{-6}$ $K^{-1}$ and the alloys of iron and manganese whose expansion coefficient is less than $2.10^{-5}$ $K^{-1}$, typically of the order of $7.10^{-6}$ $K^{-1}$. The load distribution plate 19 has a thickness of between 1 and 7 mm, preferably between 2 and 4 mm, for example of the order of 3 mm. The load distribution plate 19 advantageously has a square form whose side dimension is between 100 and 250 mm, for example of the order of 150 mm.

The top plate 40 is disposed below the load distribution plate 19 and has dimensions smaller than those of the load distribution plate 19 so that the load distribution plate 19 fully covers the top plate 40. The top plate 40 is housed in the voids 15 formed in the corner zones of the secondary insulating panels 7, in line with the bearing zones 16, that is to say in the embodiment represented in FIG. 4, in the voids 54 formed in the second layer of insulating polymer foam 12 of the secondary insulating panels 7.

The top plate 40 has a threaded bore 42 in which is fitted a threaded base of a stud 43 intended to anchor the primary insulating panels 22. In order to allow the stud 43 to be fixed to the top plate 40, the load distribution plate 19 also comprises a bore, formed in line with the threaded bore of the top plate 40, and thus allowing the stud 43 to pass through the load distribution plate 19.

The top plate 40 has a generally rectangular parallelepipedal form comprising two opposing large faces which are parallel to the supporting wall 3 and four faces which link the two large faces and extend parallel to the thicknesswise direction of the tank wall 1. In the embodiment illustrated in FIGS. 3 and 4, the four faces which extend parallel to the thicknesswise direction of the tank wall 1 are linked by fillets 44. This makes it possible to avoid the presence of sharp corners and contributes to even further limiting the phenomena of punching of the bottom plates 23 of the primary insulating panels 22 by limiting the concentrations of strains.

In an embodiment that is not illustrated, the top plate 40 and the load distribution plate 19 can be formed in a single one-piece part.

The spacer 41 is disposed between the secondary bearing plate 17 and the top plate and is thus used to maintain a separation between the secondary bearing plate 17 and the top plate 40. In the embodiment illustrated in FIGS. 3 and 4, the spacer 41 has chamfers 45 in order to lie within the bulk, seen from the thicknesswise direction of the tank wall 1, of the top plate 40. In other words, the top plate 40 fully covers the spacer 41.

The spacer 41 is advantageously made of wood which makes it possible to limit the thermal bridge to the supporting wall 3 at the retaining device 98. The spacer 41 has the form of an inverted U so as to define, between the two branches of the U, a central housing 46. The central housing 46 receives the top end of the rod 15, the locking member 39, the nut 37 and the elastic washers 38. The spacer 41 is also housed in the void 15 formed, in line with the bearing surface 16.

The locking member 39 has a square or rectangular form in which the diagonal has a size greater than the size of the central housing 46 between the two branches of the U, which makes it possible to block the rotation of the rod 15 with respect to the spacer 39 and thus prevent the rod 15 from disengaging from the nut 35.

In order to fix the load distribution plate 19, the top plate 40, the spacer 41 and the secondary bearing plate 17 to one another, the abovementioned elements are each provided with two bores through each of which passes a screw 47, 48. The bores formed in the secondary bearing plate 17 each have a threading cooperating with one of the screws 47, 48 so as to ensure the fixing of the abovementioned elements to one another.

Moreover, the stud 43 passes through a drill hole formed through a strake 21 of the secondary sealed membrane 4. The stud 43 has a flange ring 49 which is welded at its periphery around the drill hole, to ensure the sealing of the secondary sealed membrane 4. The secondary sealed membrane is therefore sandwiched between the flange ring 49 of the stud 43 and the load distribution plate 19.

The retaining device 98 also comprises a primary bearing plate 30 which bears toward the supporting wall 3 on a bearing zone 29 formed in each of the four adjacent primary insulating panels 22 so as to hold them against the supporting wall 3. In the embodiment represented, each bearing zone 29 is formed by a part overlapping the bottom plate 23 of one of the primary insulating panels 22. The primary bearing plate 30 is housed in the voids 28 formed in the corner zones of the primary insulating panels 22, in line with the bearing zones 29.

A nut 50 cooperates with a threading formed at the top end of the stud 43 so as to ensure the fixing of the primary bearing plate 30 to the stud 43. In the embodiment represented, the retaining device 98 also comprises one or more elastic washers 51, of Belleville type, which are threaded onto the stud 43 between the nut 50 and the primary bearing plate 30, which makes it possible to ensure an elastic anchoring of the primary insulating panels 22 on the supporting wall 3.

Moreover, an insulating plug 52, illustrated in FIG. 4, is inserted above the retaining device 98 in the voids 28 formed in the corner zones of four adjacent primary insulating panels 22 so as to ensure a continuity of the primary thermally insulating barrier 5 at the retaining device 98. Furthermore, a closure plate 53, made of wood, illustrated in FIG. 4, makes it possible to ensure a flatness of the support surface of the primary sealed membrane 6. The closure plate 53 is received in facings formed in the corner zones of the primary insulating panels 22.

The fixing of the primary sealed membrane 6 to the primary insulating panels 22 will now be described, according to several examples, with reference to FIGS. 6 to 14.

Figure 6:
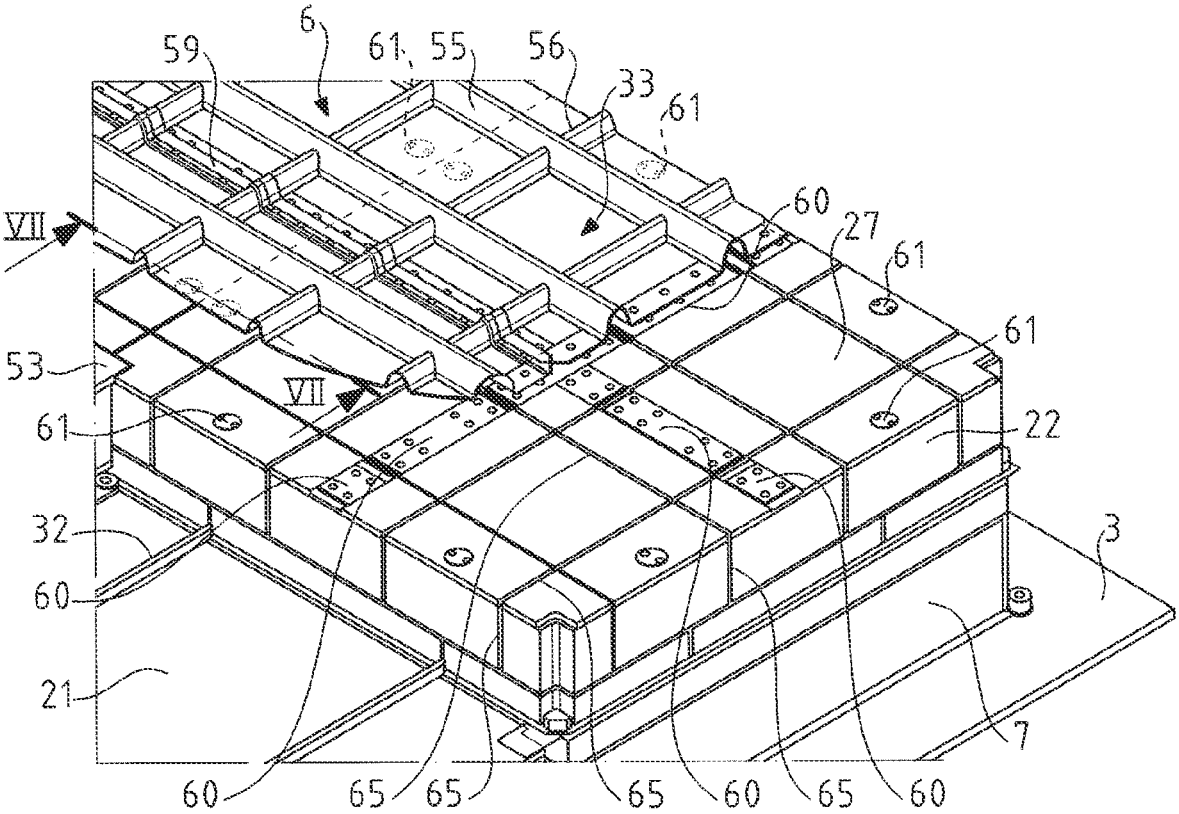
FIG. 6 is an enlarged view of the zone VI of FIG. 1, showing also means for anchoring the primary membrane according to a first embodiment.

In the embodiment of FIG. 6, the metal anchoring strips 60 are fixed onto the cover plates 27 of the primary insulating panels 22 at the outlines of the rectangular metal sheets 33. The edges of the rectangular metal sheets 33 can thus be fixed by welding along the anchoring strips 60. The anchoring strip 60 is fixed in a facing onto the cover plate 27 by any suitable means, for example screws or rivets.

Figure 7:
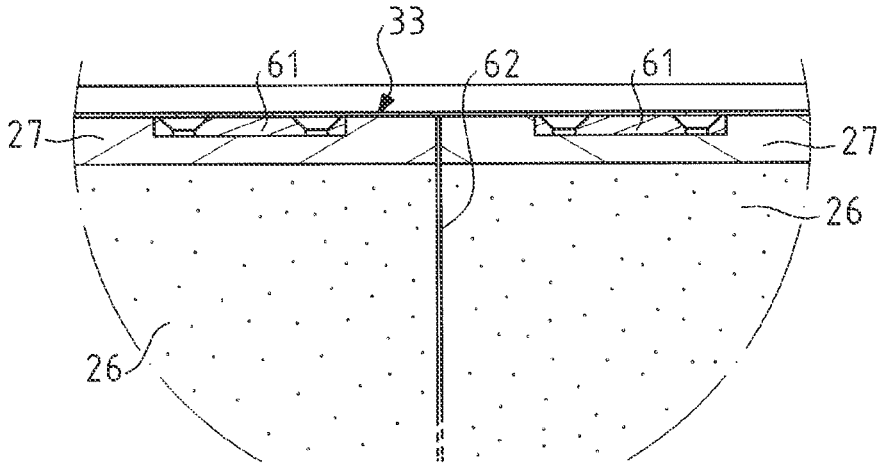
FIG. 7 is an enlarged cross-sectional view along the line VII-VII of FIG. 6.

FIGS. 6 and 7 also show metal plates 61 which can be fixed onto the cover plates 27 of the primary insulating panels 22 at other locations, for example along edges of the primary insulating panels 22 which are away from the outlines of the rectangular metal sheets 33, to provide additional fixing points. A metal plate 61 is fixed in a facing on the cover plate 27 by any suitable means, for example screws or rivets.

As can be seen better in FIG. 7, which is a cross section at an interface 62 between two primary insulating panels 22, flat zones of a rectangular metal sheet 33 can be welded by transparent welding onto the metal plates 61.

Figure 8:
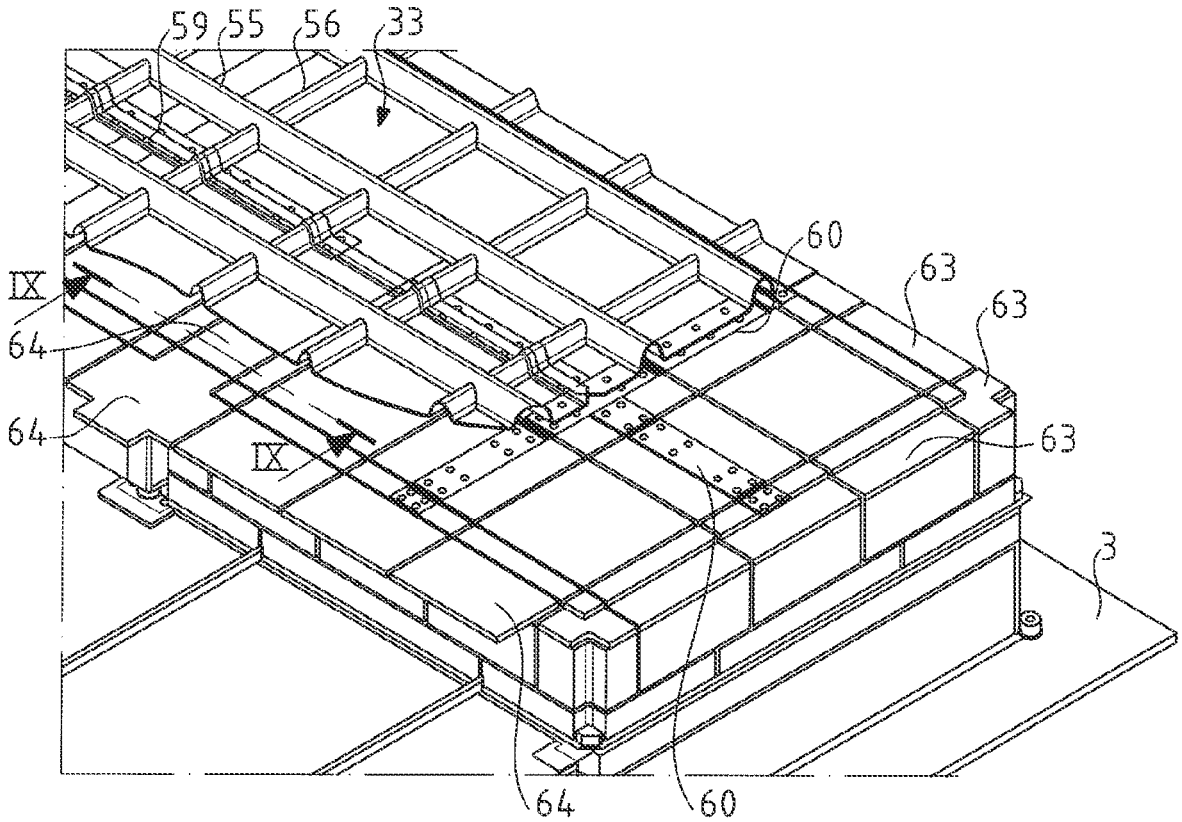
FIG. 8 is a view similar to FIG. 6, showing also bridging elements of the primary insulating barrier.
Figure 9:
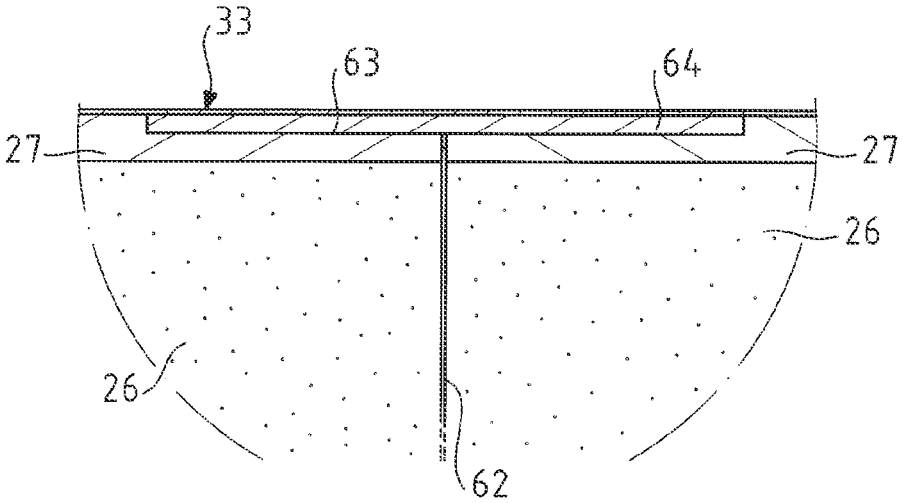
FIG. 9 is an enlarged cross-sectional view along the line IX-IX of FIG. 8.

FIGS. 8 and 9 show another embodiment of the primary insulating panels 22, whose edges have facings 63 for receiving bridging plates 64, for example made of plywood. The bridging plates 64 are fixed to the cover plates 27 of two primary insulating panels 22 to avoid a separation of the two primary insulating panels 22 at the interface 62 and thus improve the uniformity of the support surface on which the primary sealed membrane 6 rests.

In FIGS. 6 and 8, the cover plates 27 and the layers of insulating polymer foam 26 are provided with relaxation slits 65 which segment the cover plates 27 and the layers of insulating polymer foam 26 into several parts and thus avoid cracking when cooled.

Figure 10:
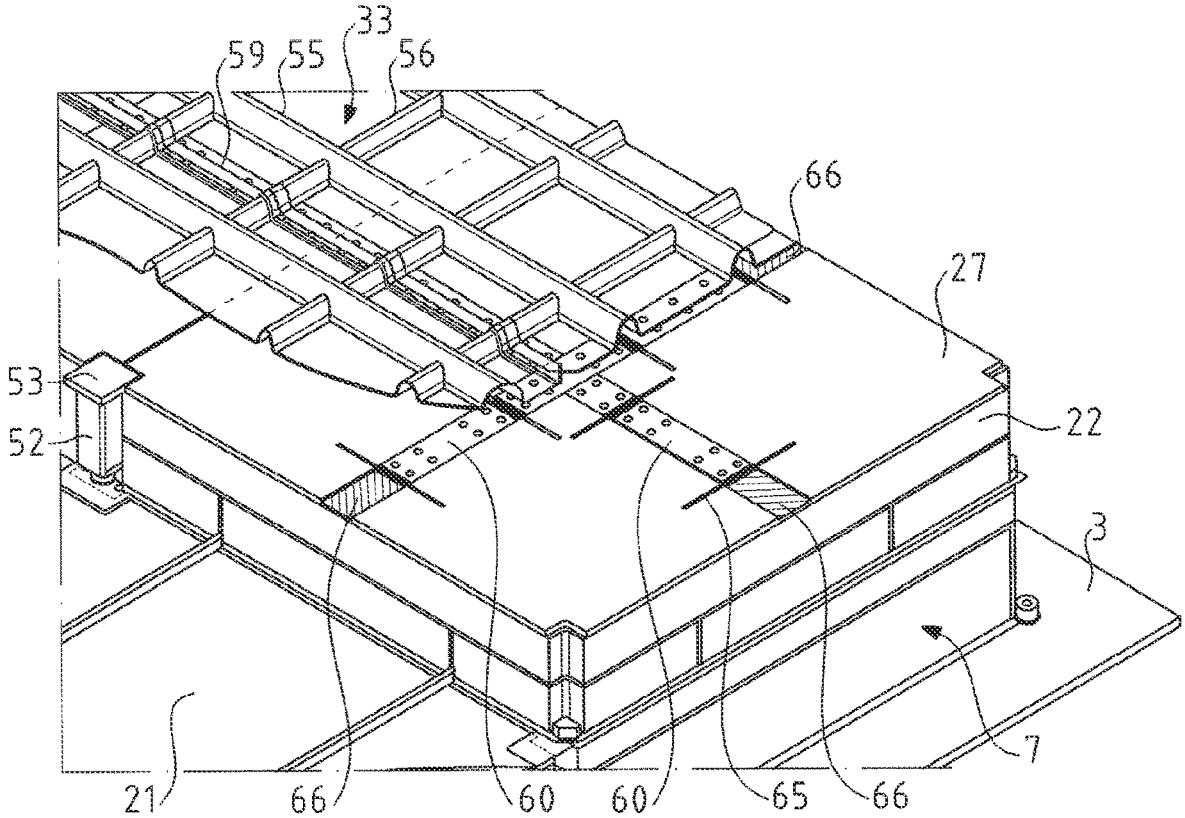
FIG. 10 is a view similar to FIG. 6, showing means for anchoring the primary membrane according to a second embodiment.

FIG. 10 shows another embodiment of the primary insulating panels 22, in which the relaxation slits 65 are limited to a zone adjacent to the anchoring strips 60, as described in the publication FR-A-3001945.

Thermal protection strips 66, for example made of composite material, are disposed in the alignment of the anchoring strips 60, in line with certain parts of the outlines of the rectangular metal sheets 33, to avoid damage to the cover plate 27 during the welding.

Figure 12:
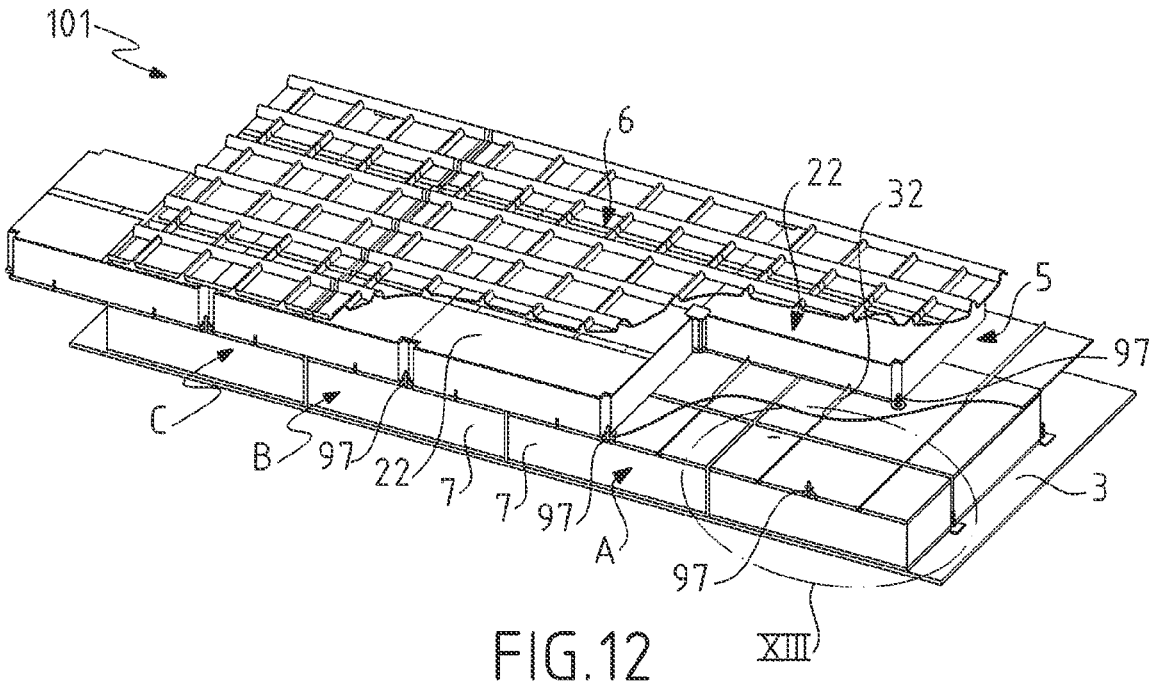
FIG. 12 is a cutaway perspective view of a tank wall according to another embodiment.

The tank wall 101 represented in FIG. 12 illustrates an embodiment in which a row of primary insulating panels 22 is superposed, not on a single row of secondary insulating panels 7, but straddling two rows of secondary insulating panels 7. The elements that are identical or similar to the elements of FIGS. 1 to 10 bear the same reference numeral as those and will be described only with respect to any differences therefrom.

Essentially two modifications have been made in FIG. 12.

On one hand, the primary retaining members 97 have been separated and offset from the secondary retaining members. The secondary retaining member, not represented, can be made in various ways, for example like the retaining device 98 from which all the elements arranged above the distribution plate 19 will have been eliminated. In this case, the load distribution plate 19 and the facing 18 intended to receive it can also be eliminated. Of the secondary retaining members, which are not represented, there can be various numbers thereof ranging for example from 2 to 5 per secondary insulating panel 7 and placed, for example, at the corners of the secondary panels and/or in the gap between two secondary panels either in the first direction or in the second direction. Other embodiments of the secondary retaining member are described in WO-A-2013093262.

Figure 13:
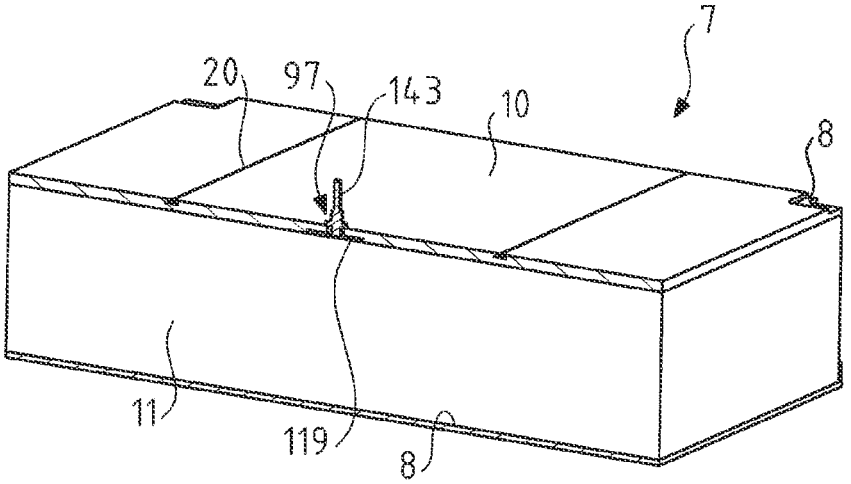
FIG. 13 is an enlarged view of the zone XIII of FIG. 12, also showing a primary anchoring member according to an embodiment.

The primary retaining member 97 can be made in various ways, for example as illustrated in the enlarged view of FIG. 13 or as described in the publication FR-A-2887010.

In FIG. 13, the primary retaining member 97 comprises a plate 119, for example having a square or circular outline, which is fixed in a facing formed in the surface of the cover plate 10 turned toward the layer of insulating polymer foam 11, for example by bonding. The plate 119 has a tapped hole emerging on the top surface of the cover plate 10 in which a stud 143, identical to the stud 43 described above, can be screwed.

Also, all of the primary stage of the tank wall, namely the primary thermally insulating barrier 5 and the primary sealed membrane 6 that it supports, has been offset in both directions of the plane by half the length of a secondary insulating panel 7. Thus, instead of being directly in line with a secondary retaining member, the primary retaining member 97 is at the center of the cover plate of a secondary insulating panel 7.

Despite this offset, a secondary retaining member still cooperates with the corners of four adjacent secondary insulating panels 7 and a primary retaining member 97 still cooperates with the corners of four adjacent primary insulating panels 22. The scale of the offset could be different and the primary retaining member 97 could be elsewhere on the cover plate of a secondary insulating panel 7, but preferably at a distance from the raised edges 32 so as not to interfere therewith. The scale of the offset can be different in both directions of the plane.

Figure 14:
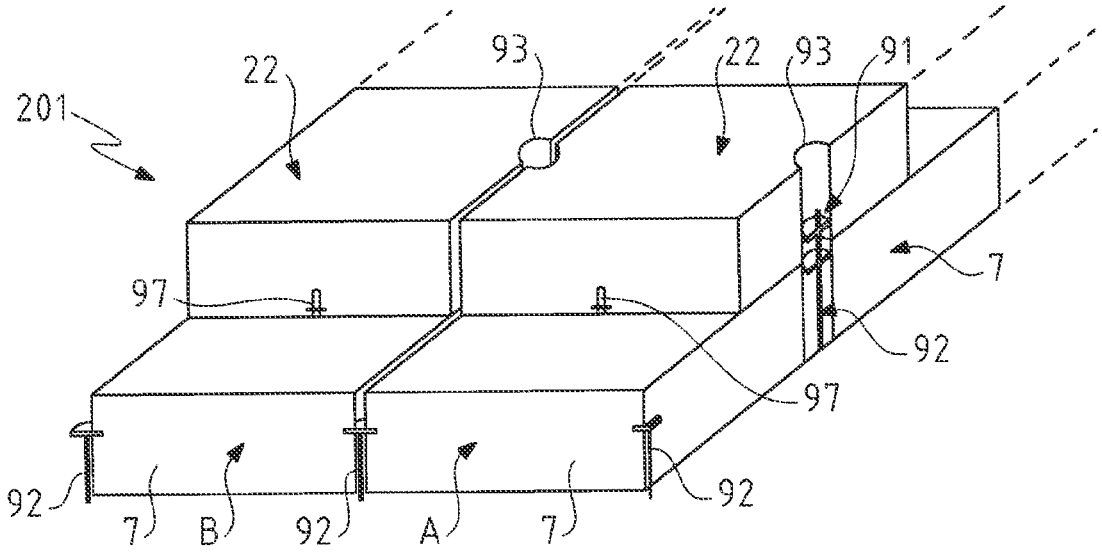
FIG. 14 is a cutaway perspective view of a tank wall according to another embodiment.

The tank wall 201 sketched in FIG. 14 illustrates an embodiment in which a row of primary insulating panels 22 is superposed on a row of secondary insulating panels 7, but offset in the first direction by a fraction of the length of an insulating panel, hereby half of this length. Thus, a primary insulating panel 22 of the primary row straddles two secondary insulating panels 7 of the underlying secondary row. The elements that are identical or similar to the elements of FIGS. 1 to 13 bear the same reference numeral as those and will be described only with respect to their differences therefrom.

In the embodiment sketched in FIG. 14, the primary insulating panels 22 are held on the secondary sealed membrane, which is not represented, by retaining members arranged in the middle of the sides of the primary insulating panels 22. Thus, the primary retaining member 97 arranged at the center of the cover plate of the secondary insulating panel 7 cooperates with two primary insulating panels 22 of the primary row and is located at mid-width of the primary row. Moreover, in the corners of the secondary insulating panels 7 there are secondary retaining members 92, as in the preceding embodiments. The secondary retaining member 92 supports a primary retaining member 91. The secondary retaining member 92 and the primary retaining member 91 that it supports can be produced in a way similar to the retaining device 98 or differently. Unlike in FIG. 1, the primary retaining member 91 here cooperates with only two primary insulating panels 22, in the middle of a side of these primary insulating panels 22.

To facilitate access to the primary retaining member 91, the form of the primary insulating panels 22 can be configured to form an access shaft 93. In this case, the shaft 93 is blocked off after the primary retaining member 91 is put in place, for example with a plug of polyurethane foam covered by a rigid sheet, for example made of plywood (not represented).

A primary sealed membrane has been described above in which the corrugations are continuous at the intersections between the two series of corrugations. The primary sealed membrane can also have two mutually right-angled series of corrugations with discontinuities of certain corrugations at the intersections between the two series. In this case, the interruptions are distributed alternately in the first series of corrugations and the second series of corrugations and, within a series of corrugations, the interruptions of a corrugation are offset with respect to the interruptions of an adjacent parallel corrugation. This offset can be equal to the spacing between two parallel corrugations.

Figure 11:
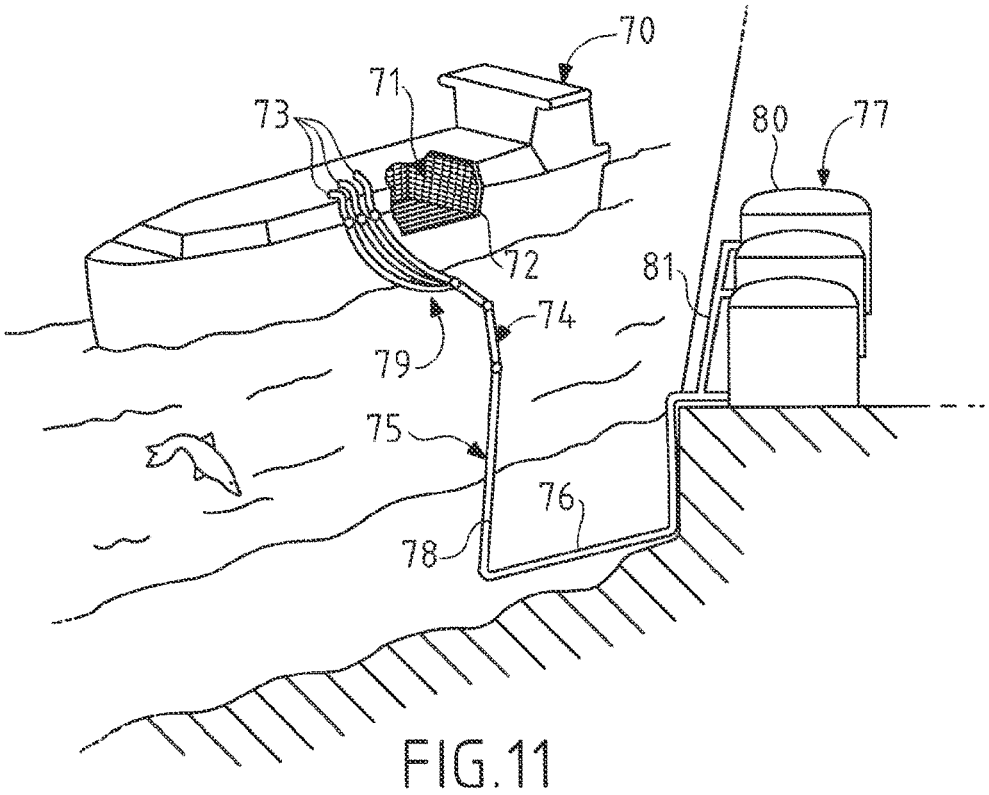
FIG. 11 is a cutaway schematic representation of a methane tanker tank and of a terminal for loading/offloading this tank.

Referring to FIG. 11, a cutaway view of a methane tanker 70 shows an insulated sealed tank 71 of generally prismatic form mounted in the double hull 72 of the ship. The wall of the tank 71 comprises a primary sealed barrier intended to be in contact with the LNG contained in the tank, a secondary sealed barrier arranged between the primary sealed barrier and the double hull 72 of the ship, and two insulating barriers arranged respectively between the primary sealed barrier and the secondary sealed barrier and between the secondary sealed barrier and the double hull 72.

As is known per se, loading/offloading pipelines 73 disposed on the top deck of the ship can be connected, by means of appropriate connectors, to maritime or port terminal to transfer an LNG cargo from or to the tank 71.

FIG. 11 represents an example of maritime terminal comprising a loading and offloading station 75, an underwater line 76 and an onshore installation 77. The loading and offloading station 75 is a fixed offshore installation comprising a mobile arm 74 and a riser 78 which supports the mobile arm 74. The mobile arm 74 supports a bundle of insulated flexible pipes 79 that can be connected to the loading/offloading pipelines 73. The steerable mobile arm 74 adapts to all methane tanker templates. A link line that is not represented extends inside the riser 78. The loading and offloading station 75 makes it possible to load and offload the methane tanker 70 from or to the onshore installation 77. The latter comprises liquefied gas storage tanks 80 and link lines 81 linked by the underwater line 76 to the loading or offloading station 75. The underwater line 76 allows the transfer of the liquefied gas between the loading or offloading station 75 and the onshore installation 77 over a great distance, for example 5 km, which makes it possible to keep the methane tanker 70 at a great distance from the coast during the loading and offloading operations.

To generate the pressure necessary to the transfer of the liquefied gas, pumps embedded in the ship 70 and/or pumps with which the onshore installation 77 is equipped and/or pumps with which the loading and offloading station 75 is equipped are implemented.

Although the invention has been described in connection with several particular embodiments, it is clear that it is in no way limited thereto and that it comprises all the technical equivalents of the means described and the combinations thereof provided the latter fall within the context of the invention.

The use of the verb "comprise" or "include" and its conjugate forms does not preclude the presence of elements or steps other than those stated in a claim.

In the claims, any reference symbol between parentheses should not be interpreted as a limitation on that claim.

The invention claimed is:

1. A thermally-insulating sealed tank incorporated in a supporting structure, the tank comprising a tank wall fixed onto a supporting wall of the supporting structure, the tank wall comprising a primary sealed membrane intended to be in contact with a product contained in the tank, a secondary sealed membrane arranged between the primary sealed membrane and the supporting wall, a primary insulating barrier arranged between the primary sealed membrane the secondary sealed membrane and a secondary insulating barrier arranged between the secondary sealed membrane and the supporting wall, wherein the secondary insulating barrier comprises a plurality of secondary rows parallel to a first direction, a secondary row comprising a plurality of juxtaposed parallelepipedal secondary insulating panels, the secondary rows being juxtaposed in a second direction at right angles to the first direction according to a repeated pattern, wherein the secondary sealed membrane comprises a plurality of strakes to the first direction, a strake comprising a flat central portion resting on a top surface of the secondary insulating panels and two raised edges protruding toward the interior of the tank with respect to the central portion, the strakes being juxtaposed in the second direction according to a repeated pattern and welded together tightly at the raised edges, anchoring wings anchored to the secondary insulating panels and parallel to the first direction being arranged between the juxtaposed strakes to hold the secondary sealed membrane on the secondary insulating barrier, wherein the size of the repeated pattern of the secondary rows is an integer multiple of the size of a strake in the second direction, wherein the supporting wall supports secondary retaining members cooperating with the secondary insulating panels to hold the secondary insulating panels on the supporting wall, wherein the primary insulating barrier comprises a plurality of primary rows parallel to the first direction, a primary row comprising a plurality of juxtaposed parallelepipedal primary insulating panels, the primary rows being juxtaposed in the second direction according to a repeated pattern, the size of the repeated pattern of the primary rows being equal to the size of the repeated pattern of the secondary rows in the second direction, wherein the primary retaining members are disposed at the interfaces between the primary rows and cooperate with the primary insulating panels to hold the primary insulating panels on the secondary sealed membrane, wherein the primary sealed membrane has first corrugations parallel to the first direction and disposed according to a repeated pattern in the second direction and flat portions situated between the first corrugations and resting on a top surface of the primary insulating panels, and wherein the size of the repeated pattern of the primary rows is an integer multiple of the size of the repeated pattern of the first corrugations, the primary sealed membrane comprising a plurality of rows of metal sheets parallel to the first direction, a row of metal sheets comprising a plurality of rectangular metal sheets welded together by edge zones, the rows of metal sheets being juxtaposed in the second direction and welded together, the size of a row of metal sheets in the second direction being equal to an integer multiple of the size of the repeated pattern of the primary rows, the rows of metal sheets being offset in the second direction with respect to the primary rows such that the welded joints between the rows of metal sheets are situated at a distance from the interfaces between the primary rows.

2. The tank as claimed in claim 1, wherein the or each primary row is superposed straddling two secondary rows and wherein the primary retaining members are supported by the secondary insulating panels.

3. The tank as claimed in claim 2, wherein the primary rows are offset in the second direction by a half of the size of the repeated pattern of the secondary rows with respect to the secondary rows.

4. The tank as claimed in claim 2, wherein the interfaces between the primary insulating panels within the or each primary row are offset in the first direction with respect to the interfaces between the secondary insulating panels within the two secondary rows on which the primary row is superposed, and wherein the primary retaining members are supported by the secondary insulating panels at a distance from the edges of the secondary insulating panels.

5. The tank as claimed in claim 2, wherein a primary retaining member comprises a plate fixed to a cover plate of the secondary insulating panel under the secondary sealed membrane and a rod attached to said plate and passing through the secondary sealed membrane toward the primary insulating barrier.

6. The tank as claimed in claim 1, wherein each primary row is superposed on a secondary row and wherein the primary retaining members are supported by the secondary retaining members.

7. The tank as claimed in claim 1, wherein the first corrugations are spaced apart by a first regular spacing in the second direction.

8. The tank as claimed in claim 7, wherein the size of a strake in the second direction is an integer multiple of said first regular spacing.

9. The tank as claimed in claim 1, wherein a primary row comprises a plurality of parallelepipedal primary insulating panels juxtaposed according to a repeated pattern and a row of metal sheets of the primary sealed membrane comprises a plurality of rectangular metal sheets juxtaposed according to a repeated pattern, the size of the repeated pattern of the rectangular metal sheets being equal to an integer multiple of the size of the repeated pattern of the primary insulating panels in the first direction.

10. The tank as claimed in claim 9, wherein the edges of the rectangular metal sheets are offset in the first direction with respect to the edges of the primary insulating panels parallel to the second direction, such that the welded joints between the rectangular metal sheets are situated at a distance from the edges of the primary insulating panels parallel to the second direction.

11. The tank as claimed in claim 1, wherein the primary insulating panels and/or the secondary insulating panels have a square form.

12. The tank as claimed in claim 1, wherein the primary sealed membrane also has second corrugations parallel to the second direction and disposed according to a repeated pattern in the first direction, the flat portions being situated between the first corrugations and between the second corrugations.

13. The tank as claimed in claim 12, wherein the second corrugations parallel to the second direction are spaced apart by a second regular spacing in the first direction.

14. The tank as claimed in claim 13, wherein the first corrugations are spaced apart by a first regular spacing in the second direction and wherein the first regular spacing is equal to a second regular spacing.

15. The tank as claimed in claim 12, wherein the first and second corrugations are continuous at the intersections between first and second corrugations.

16. The tank as claimed in claim 12, wherein the first and second corrugations are discontinuous at the intersections between the first and second corrugations.

17. The tank as claimed in claim 12, wherein a rectangular metal sheet of the primary sealed membrane has a size in the first direction substantially equal to an integer multiple of the size of the repeated pattern of the second corrugations.

18. The tank as claimed in claim 1, wherein a primary insulating panel comprises a bottom plate resting against the primary sealed membrane, an intermediate plate disposed between the bottom plate and a cover plate, a first layer of insulating polymer foam sandwiched between the bottom plate and the intermediate plate and a second layer of insulating polymer foam sandwiched between the intermediate plate and the cover plate.

19. The tank as claimed in claim 1, wherein the primary sealed membrane is held on the primary insulating barrier by anchoring means, the anchoring means comprising metal anchoring strips fixed onto the primary insulating panels at locations corresponding to outlines of the rectangular metal sheets and to which edge zones of the rectangular metal sheets can be welded.

20. The tank as claimed in claim 19, wherein a primary insulating panel comprises relaxation slits hollowed out in a thicknesswise direction of the primary insulating panel and emerging on a cover plate of the primary insulating panel and wherein a metal anchoring strip comprises several aligned segments, fixed onto the cover plate and separated by the relaxation slits.

21. The tank as claimed in claim 1, wherein the primary sealed membrane is held on the primary insulating barrier by anchoring means, the anchoring means comprising metal inserts fixed onto the primary insulating panels at locations corresponding to edge zones of the primary insulating panels at a distance from the outlines of the rectangular metal sheets and to which central zones of the rectangular metal sheets can be welded.

22. The tank as claimed in claim 21, wherein a primary insulating panel comprises relaxation slits hollowed out in a thicknesswise direction of the primary insulating panel and emerging on a cover plate of the primary insulating panel and wherein the metal inserts are fixed onto the cover plate between the relaxation slits.

23. The tank as claimed in claim 1, wherein the primary insulating barrier comprises a bridging element fixed to the top surfaces of at least two adjacent primary insulating panels to avoid a separation of the two primary insulating panels.

24. The tank as claimed in claim 23, wherein said primary insulating panels have facings on edges of the top surface to receive said bridging element.

25. A ship for transporting a fluid, the ship comprising a double hull and a tank as claimed in claim 1 disposed in the double hull.

26. A transfer system for a fluid, the system comprising a ship as claimed in claim 25, insulated pipelines arranged so as to link the tank installed in the hull of the ship to a floating or onshore storage installation and a pump for driving a fluid through the insulated pipelines from or to the floating or onshore storage installation to or from the tank of the ship.

27. A method for loading or offloading a ship as claimed in claim 25, wherein a fluid is conveyed through insulated pipelines from or to a floating or onshore storage installation to or from the tank of the ship.

28. The tank of claim 1, wherein the plurality of strakes are made of an alloy with a low expansion coefficient that is less than or equal to $7.10^{-6}$ $K^{-1}$.

29. The tank of claim 1, wherein the secondary retaining members are disposed at the interfaces between the secondary rows.

30. The tank of claim 1, wherein the secondary retaining members are placed at the corners of the secondary insulating panels.

* * * * *